US012329252B2

(12) United States Patent
Jensen et al.

(10) Patent No.: US 12,329,252 B2
(45) Date of Patent: Jun. 17, 2025

(54) ARTICLE OF JEWELRY WITH MAGNETIC CLASP ASSEMBLY

(71) Applicant: ZL Holdings, LLC, St. George, UT (US)

(72) Inventors: Paul Jensen, St. George, UT (US); Riley White, Hurricane, UT (US)

(73) Assignee: ZL Holdings, LLC, St. George, UT (US)

( * ) Notice: Subject to any disclaimer, the term of this patent is extended or adjusted under 35 U.S.C. 154(b) by 0 days.

(21) Appl. No.: 18/352,139

(22) Filed: Jul. 13, 2023

(65) Prior Publication Data

US 2024/0016262 A1 Jan. 18, 2024

Related U.S. Application Data

(60) Provisional application No. 63/377,786, filed on Sep. 30, 2022, provisional application No. 63/368,442, filed on Jul. 14, 2022.

(51) Int. Cl.
*A44C 5/20* (2006.01)

(52) U.S. Cl.
CPC ..... *A44C 5/2066* (2013.01); *A44D 2203/00* (2013.01)

(58) Field of Classification Search
CPC ..... A44C 5/2066; A44C 5/185; A44C 5/2042; A44C 5/20; A44C 5/0053; A44C 17/0241; A44C 17/208; A44C 17/025; A44C 25/007; A44C 15/0025; A44C 5/025; A44D 2203/00; Y10T 24/4736; A44B 11/12; A44B 11/16; A44B 11/006
USPC ..... 63/3, 23, 33, 43
See application file for complete search history.

(56) References Cited

U.S. PATENT DOCUMENTS

| | | | | |
|---|---|---|---|---|
| 2,648,884 | A | 8/1953 | Loofboro | |
| 3,404,440 | A | 10/1968 | Weiss | |
| 6,880,364 | B1 * | 4/2005 | Vidolin | A44C 5/025 40/633 |
| 9,101,185 | B1 | 8/2015 | Greenberg | |
| 11,950,663 | B1 * | 4/2024 | Rowland | A44B 11/16 |
| 2002/0112323 | A1 | 8/2002 | Nire | |
| 2008/0028791 | A1 * | 2/2008 | Nardin | A44C 5/2076 63/3.1 |
| 2011/0289737 | A1 | 12/2011 | Ninomiya et al. | |
| 2014/0093850 | A1 * | 4/2014 | Georgi | A44C 5/0015 434/238 |

(Continued)

*Primary Examiner* — Jack W Lavinder
(74) *Attorney, Agent, or Firm* — Gurr & Brande, PLLC; Robert A. Gurr

(57) ABSTRACT

A magnetic clasp assembly includes a first member and a second member each couplable to an end of a bracelet. The first member may be readily secured or removed from the bracelet by actuating a lever. The second member may be coupled to the first member via a second protrusion on the second member being inserted into a first receiving slot of the first member, and a first protrusion couplable to a second receiving slot of the second member. Magnets may be used to ensure the first and second member remain coupled. By actuating the lever to remove the first member, the article of jewelry with magnetic clasp assembly facilitates the convenient attachment and removal of slider charms and other ornamental accessories from the bracelet. Such slider charms may feature designs representing a user's life achievements and interests.

5 Claims, 6 Drawing Sheets

(56) References Cited

U.S. PATENT DOCUMENTS

| | | | | |
|---|---|---|---|---|
| 2016/0316839 | A1 | 11/2016 | King | |
| 2018/0132570 | A1* | 5/2018 | Chen | A41F 1/002 |
| 2019/0069648 | A1 | 3/2019 | Duncan et al. | |
| 2022/0330664 | A1* | 10/2022 | Li | A44B 11/258 |

* cited by examiner

ARTICLE OF JEWELRY WITH MAGNETIC CLASP ASSEMBLY

CROSS-REFERENCE TO RELATED APPLICATIONS

This application claims the benefit of U.S. Provisional Application Ser. No. 63/377,786, filed on Sep. 30, 2022 and U.S. Provisional Application Ser. No. 63/368,442, filed on Jul. 14, 2022, each of which are incorporated herein by reference.

TECHNICAL FIELD

The present disclosure relates to jewelry fasteners. More particularly, this disclosure relates to an article of jewelry with a magnetic clasp assembly.

BACKGROUND

A jewelry clasp, or jewelry fastener, is the mechanical mechanism that allows a necklace or bracelet to easily be put on and taken off without causing any damage to the jewelry. Some fasteners are meant to be hidden, while others are a key element to the overall design. Common variants of jewelry fasteners include ball, slide, swivel, push button, fishhook, lobster, and buckle clasps. Such closure mechanisms, however, can be difficult to quickly attach and remove, uncomfortable to wear, and distract aesthetically from other elements of the jewelry.

A charm bracelet, in particular, is a type of bracelet which carries personal jeweled ornaments or "charms," such as decorative pendants and trinkets. The decorative charms usually carry personal or sentimental attachment for the user. In some cases, a charm bracelet can further be used to display and celebrate the user's accomplishments and significant life events. Interchanging which charms are displayed on the charm bracelet or other article of jewelry may require the user to frequently open and close the jewelry fastener and slide the charms both over the jewelry fastener and along the band of the bracelet. This process is complicated if the jewelry fastener is too bulky and thus unable to be readily threaded through the charms. Moreover, the jewelry fastener is essential to creating a comfortable fit around the wrist or neck and most jewelry fasteners do not enable the user to adjust the length of the band of the bracelet without removing links or substituting the standard band of the bracelet for a smaller or larger size.

Accordingly, there is a need for an article of jewelry, in particular a charm bracelet, with a detachable jewelry fastener that easily facilitates the interchange of new charms and accessories, and which permits adjustment of the bracelet's sizing. The present disclosure solves these and other problems.

SUMMARY OF EXAMPLE EMBODIMENTS

In some embodiments, an article of jewelry comprises a bracelet and a magnetic clasp assembly detachably couplable to the bracelet. The magnetic clasp assembly further comprises a first member removably couplable to a first end of the bracelet and a second member coupled to a second end of the bracelet. The first member comprises a first engagement area, a lever arm groove, and a lever, wherein the first engagement area comprises a first magnet cavity, a first magnet couplable to the first magnet cavity, a first protrusion, and a first receiving slot. The first member may further comprise a first aperture, a second aperture, a channel between the first and second apertures, and a pin couplable through the channel to the lever, wherein the lever is configured to be actuated in relation to the first member. The second member comprises a second engagement area couplable to the first engagement area. The second engagement area comprises a second magnet cavity, a second magnet couplable to the second magnet cavity, a second protrusion, and a second receiving slot. In some embodiments, the lever of the article of jewelry with magnetic clasp assembly further comprises a plurality of protrusions opposite a plurality of ridges on the first member. Interaction between the plurality of protrusions and the plurality of ridges enables greater friction between the bracelet and the first member, preventing unwanted withdrawal of the bracelet from the first member. Actuating the lever facilitates removal of the first member, allowing a user to add or remove charms to the bracelet.

In some embodiments, a method of using an article of jewelry comprises coupling a first member to a second member of a magnetic clasp assembly by coupling the second protrusion with the first receiving slot, coupling the first protrusion with the second receiving slot, and engaging through proximity the first magnet and the second magnet. A user may readily couple the bracelet to the first member by placing a band, chain, or rope of an article of jewelry into a bracelet cavity of the first member, and actuating the lever from an open configuration to a closed configuration. The first member may be removed from the bracelet to facilitate the addition or removal of charms by actuating the lever in the reverse direction.

DETAILED DESCRIPTION OF EXAMPLE EMBODIMENTS

Figure 1:
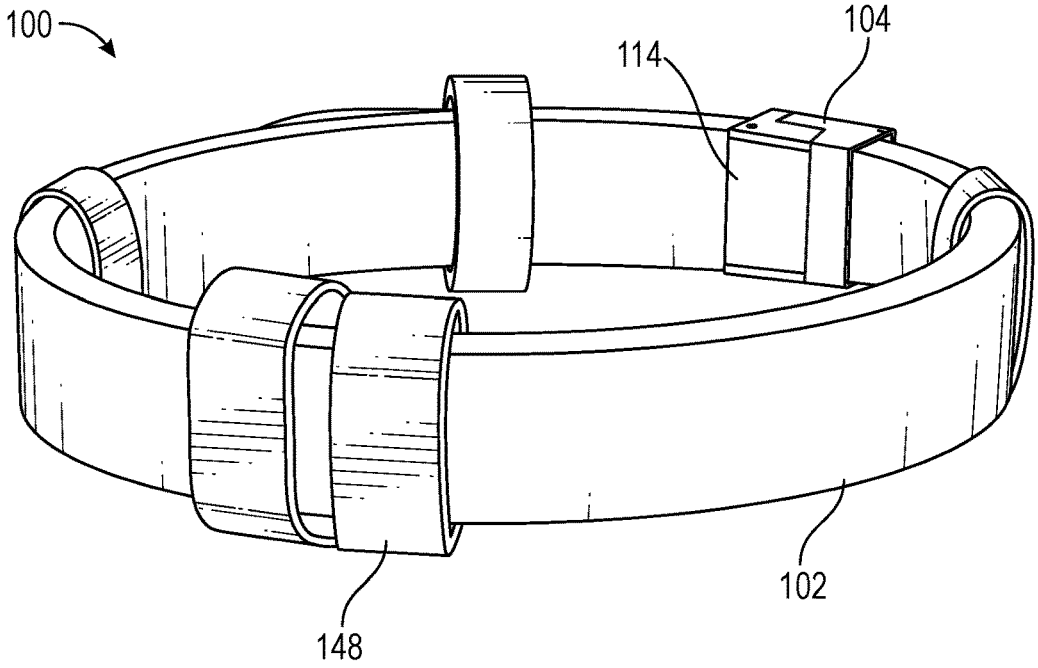
FIG. 1 illustrates a top, side perspective view of an article of jewelry with a magnetic clasp assembly.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for an article of jewelry, in particular a charm bracelet, with a detachable magnetic clasp assembly that easily facilitates the exchange of new charms and accessories, and which also permits adjustment of the bracelet's sizing. The present disclosure addresses these and other problems As illustrated in FIG. 1, in some embodiments, an article of jewelry with magnetic clasp assembly 100 comprises a bracelet 102 and a magnetic clasp assembly 104 detachably couplable to the bracelet 102. The bracelet may comprise a band, chain, rope, or other form factor that is capable of being fed through the magnetic clasp assembly 104 and secured while being worn. The bracelet 102 may alternatively be a necklace, anklet, armband, or related article of jewelry worn on other parts of the body. The magnetic clasp assembly 104 is configured to grip and release material of the bracelet 102 via a lever 114 in order to add or remove slider charms 148, as well as to adjust a size of the bracelet 102 as desired by the user.

Figure 2:
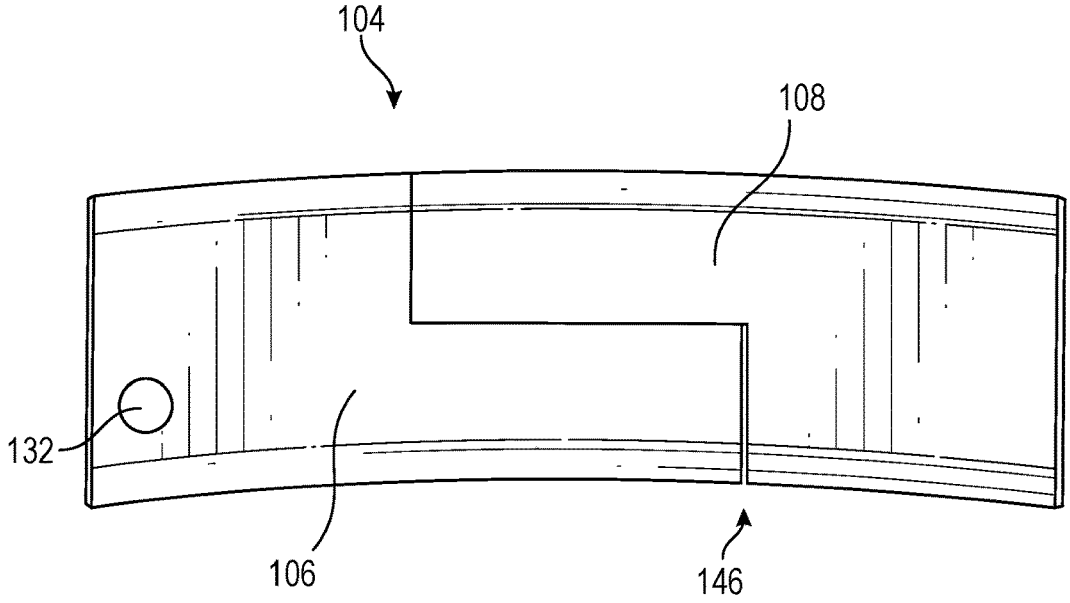
FIG. 2 illustrates a left side elevation view of a magnetic clasp assembly.

As illustrated in FIG. 2, in some embodiments, the magnetic clasp assembly 104 comprises a first member 106 and a second member 108 detachably couplable to the first member 106. As shown, though without limitation, the first member 106 and the second member 108 may be substantially symmetrical in shape and configured to overlap with one another, thereby forming a complete magnetic clasp assembly 104 that is smooth and rectangular when fastened to the bracelet 102. It will be appreciated, however, by those skilled in the art, that the first member 106 and the second member 108 of the magnetic clasp assembly 104 may be asymmetrical and couplable together to form other shapes.

Referring to FIGS. 3-7, the first member 106 comprises a first engagement area 110, a lever arm groove 112 couplable to the lever 114. The first engagement area 110 comprises a first magnet cavity 116, a first magnet 118 couplable within the first magnet cavity 116, a first protrusion 120, and a first receiving slot 122. The second member 108 comprises a second engagement area 134 couplable to the first engagement area 110, and a compartment 152 for receiving an end of the bracelet 102 (which may be secured therein using adhesives, a set screw, or similar securing mechanism). The second engagement area 134 comprises a second magnet cavity 150, a second magnet 138 couplable within the second magnet cavity 150, a second protrusion 140, and a second receiving slot 142.

A first surface of the first magnet 118 may be configured to be a north pole and a first surface of the second magnet 138 may be configured to be a south pole or vice versa to permit attraction between the first and second magnets 118, 138 when placed in close proximity to one another. Interaction between the first and second magnets 118, 138 facilitates fastening together of the first member 106 with the second member 108 of the magnetic clasp assembly 104 as a whole (e.g., FIG. 2). Additionally, the first protrusion 120 is couplable to the second receiving slot 142 through interlocking or compression fit and the second protrusion 140 is likewise couplable to the first receiving slot 122 by interlocking or compression fit. These additional means of securement ensure proper alignment of the first member 106 and second member 108. For example, a user would tilt the second member 108 such that the second protrusion 140 is insertable into the first receiving slot 122. Once received, the second member may then be pressed downwardly such that the second receiving slot 142 receives the first protrusion 120. As the second magnet 138 approximates the first magnet 118, they are attracted to one another, securing the second member 108 to the first member 106. Accordingly, the user may decouple the first member 106 from the second member 108 only through intentional application of force to break the magnetic field and to remove the second protrusion 140 from the first receiving slot 122 at the correct angle.

Figure 7:
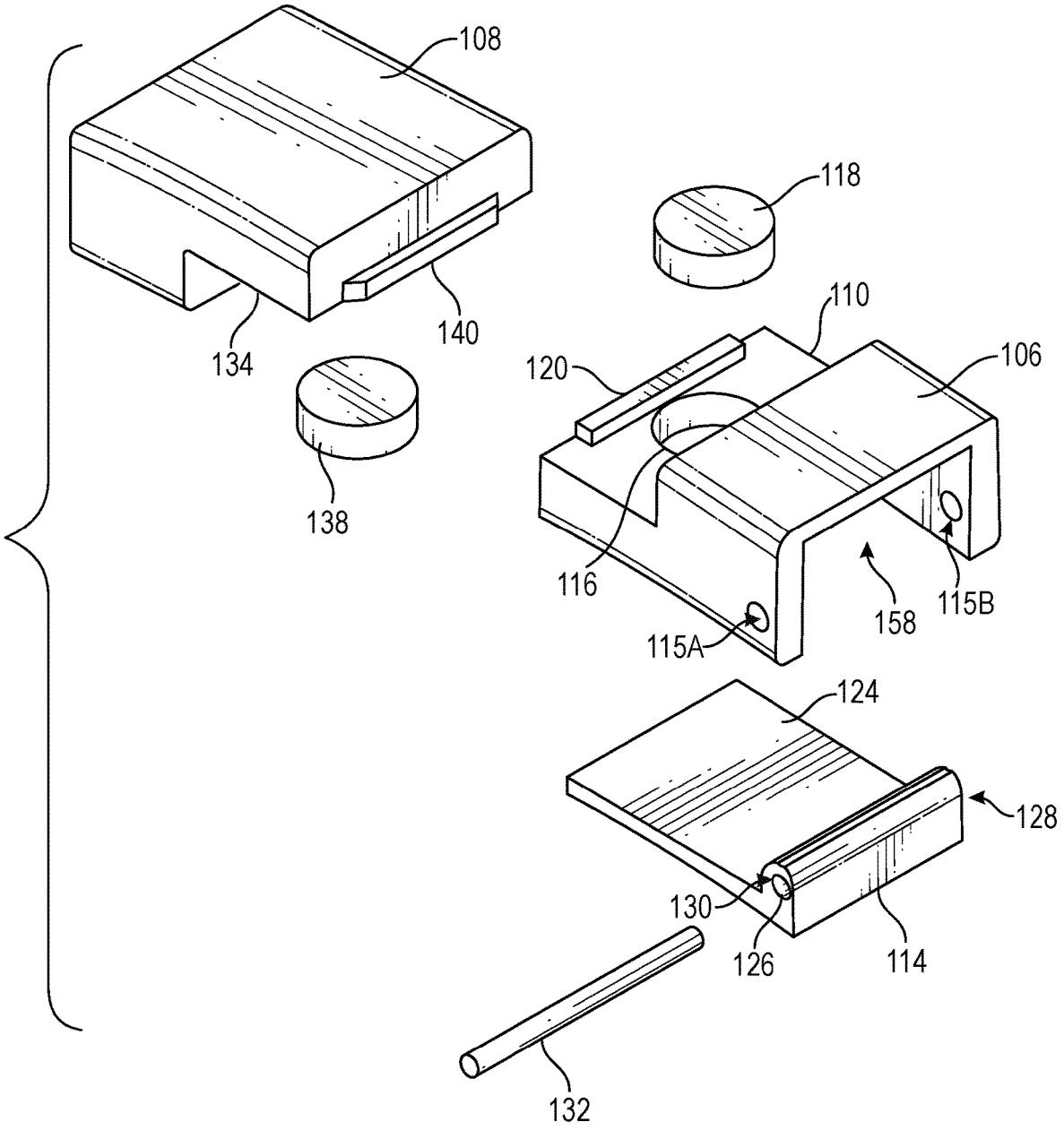
FIG. 7 illustrates an exploded view of a magnetic clasp assembly.
Figure 8:
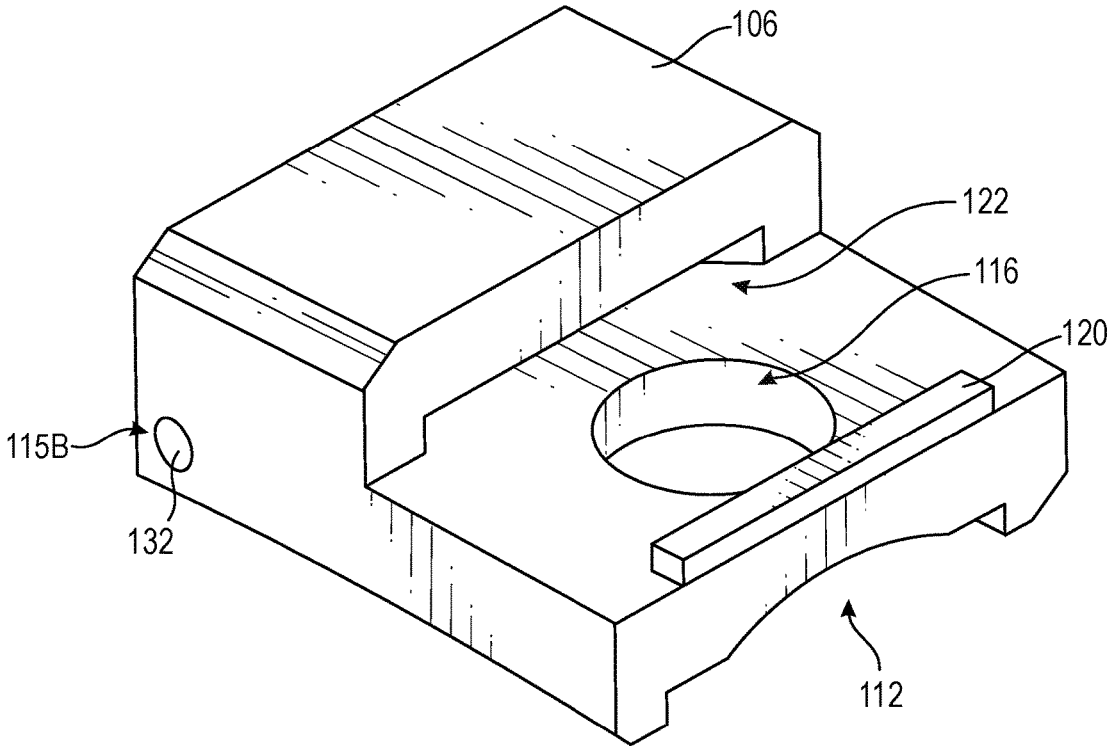
FIG. 8 illustrates a top, side perspective view of a first member.
Figure 9:
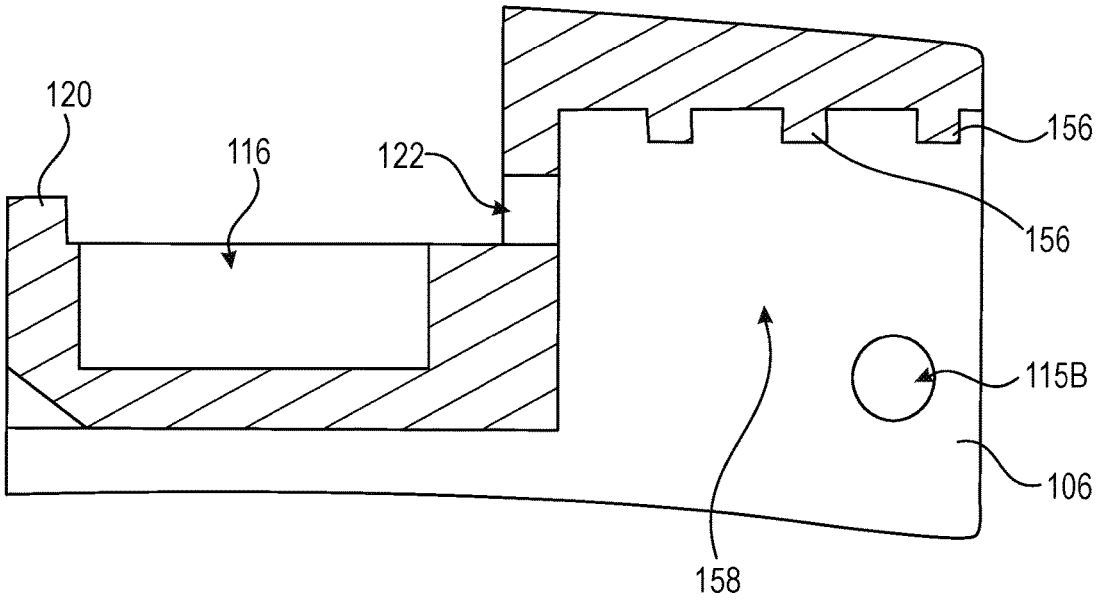
FIG. 9 illustrates a left side elevation, sectional view of a first member.

As best seen in FIG. 7, the lever 114 comprises an arm 124, a first aperture 126, a second aperture 128, a channel 130 between the first and second apertures 126, 128, and a pin 132 receivable through the channel 130 that couples the lever 114 within a bracelet cavity 158 of the first member 106 via pin apertures 115A-B. As appreciated, the pin 132 functions as a hinge for the lever 114. In some embodiments, as illustrated in FIG. 8, the lever arm groove 112 may be rounded rather than square, with the lever arm 124 complementary in shape, so as to be comfortable against a user's arm. Moreover, as best seen in FIG. 9, the first member 106 may have a plurality of ridges 156 within the bracelet cavity 158 to engage with and secure the bracelet 102 between the lever 114 and other ridges, as discussed in more detail later herein. The plurality of ridges 156, in some embodiments, may be positioned on an internal surface of the first member 106 and comprise, without limitation, narrow raised bands having a square shape that are spaced at even intervals to create friction against the bracelet when positioned within the bracelet cavity 158.

Figure 3:
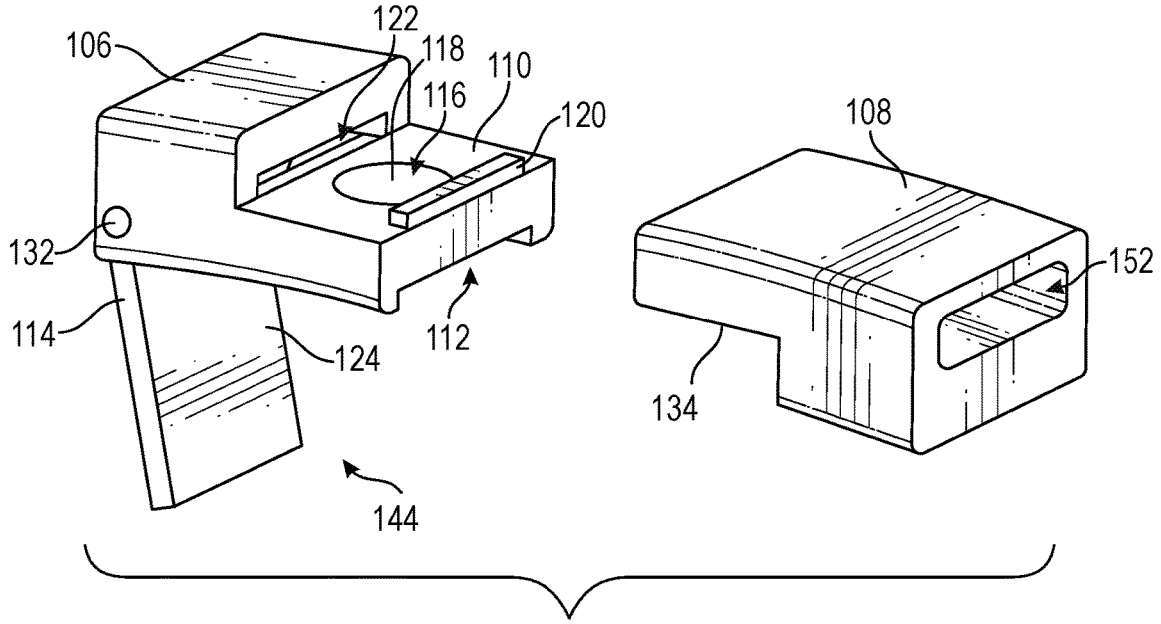
FIG. 3 illustrates a top, left side perspective view of a magnetic clasp assembly disassembled.
Figure 4:
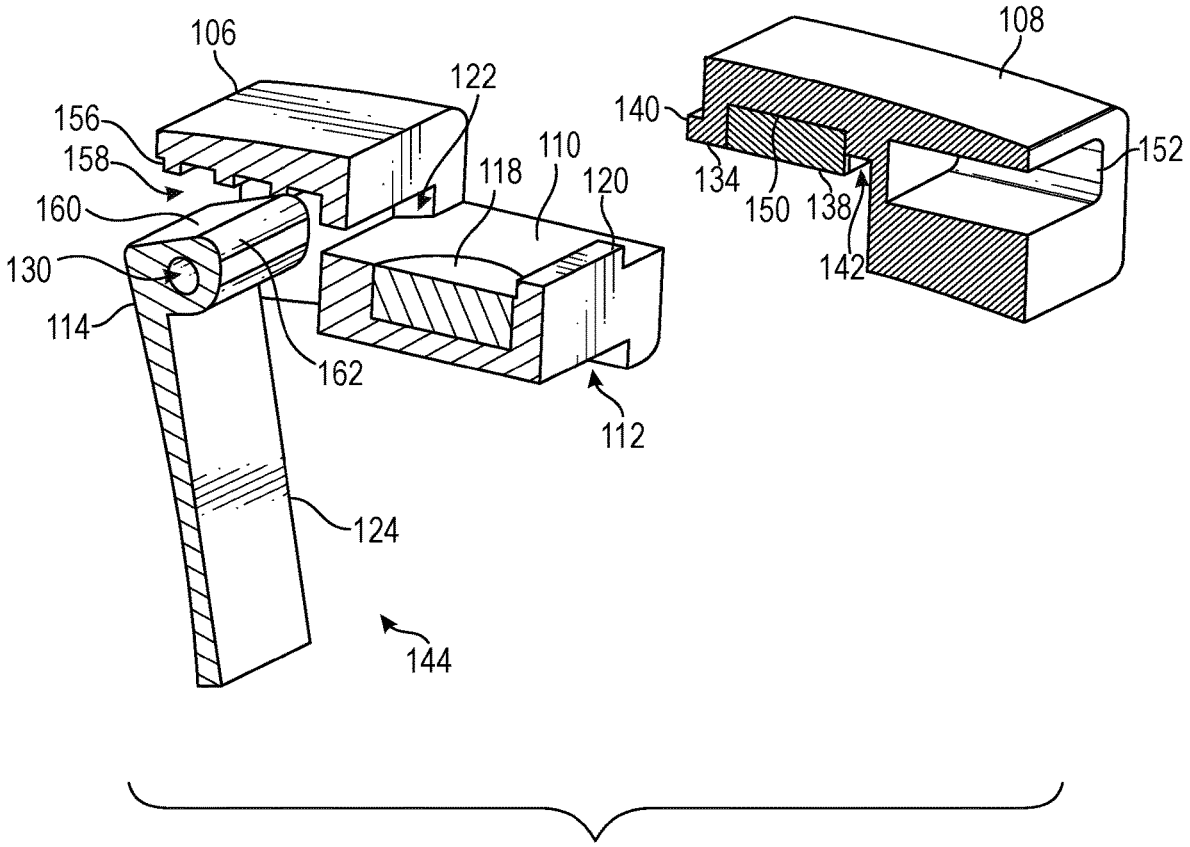
FIG. 4 illustrates a top, left side cross-sectional view of a magnetic clasp assembly disassembled.
Figure 5:
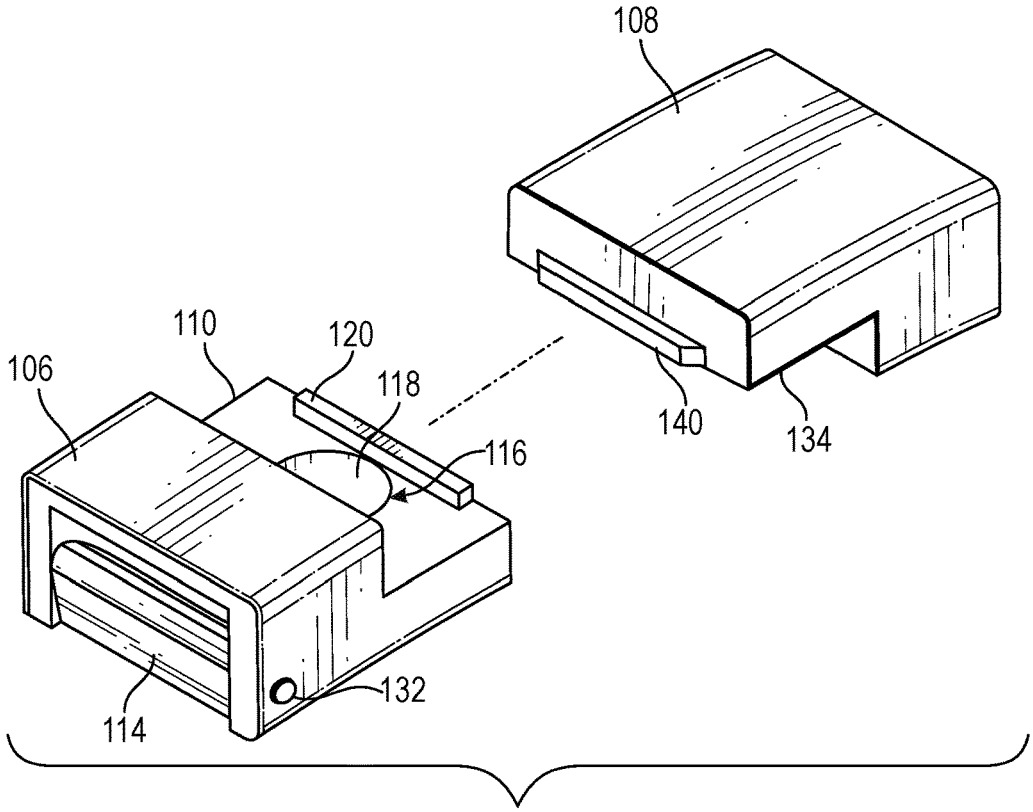
FIG. 5 illustrates a top, side perspective view of a magnetic clasp assembly disassembled.
Figure 6:
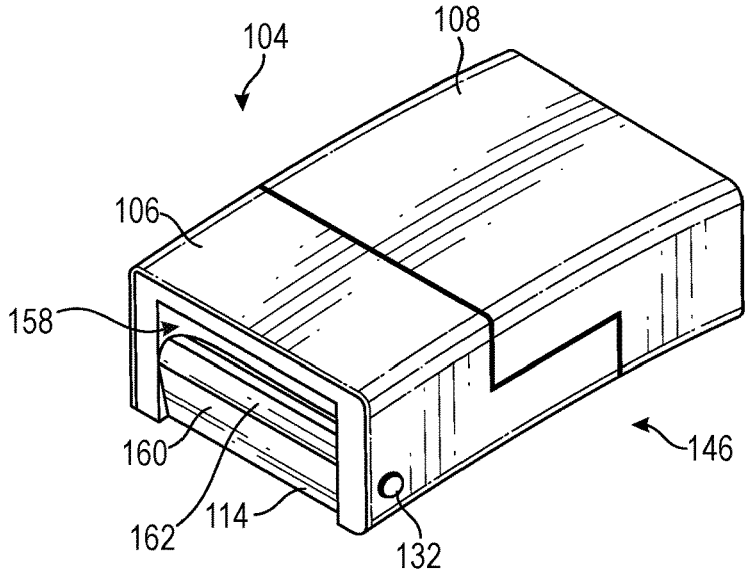
FIG. 6 illustrates a top, side perspective view of a magnetic clasp assembly assembled.

Speaking functionally, the lever 114 may be actuated in order to couple the magnetic clasp assembly 104 to the bracelet 102. When the lever 114 is in an open configuration 144, as best seen in FIGS. 3-4, an end of the bracelet 102 or other jewelry such as the band, chain, or rope may be fed into the bracelet cavity 158, interposed between the top end 160 of the lever 114 and the plurality of ridges 156 of the first member 106. Next, the lever 114 may be actuated by forcing the lever arm 124 into the lever arm groove 112. In so doing, a raised end 162 applies a force to the bracelet 102, pinching the bracelet 102 between the raised end 162 and the plurality of ridges 156, forming a closed configuration 146, as best seen in FIGS. 1-2.

Figure 10:
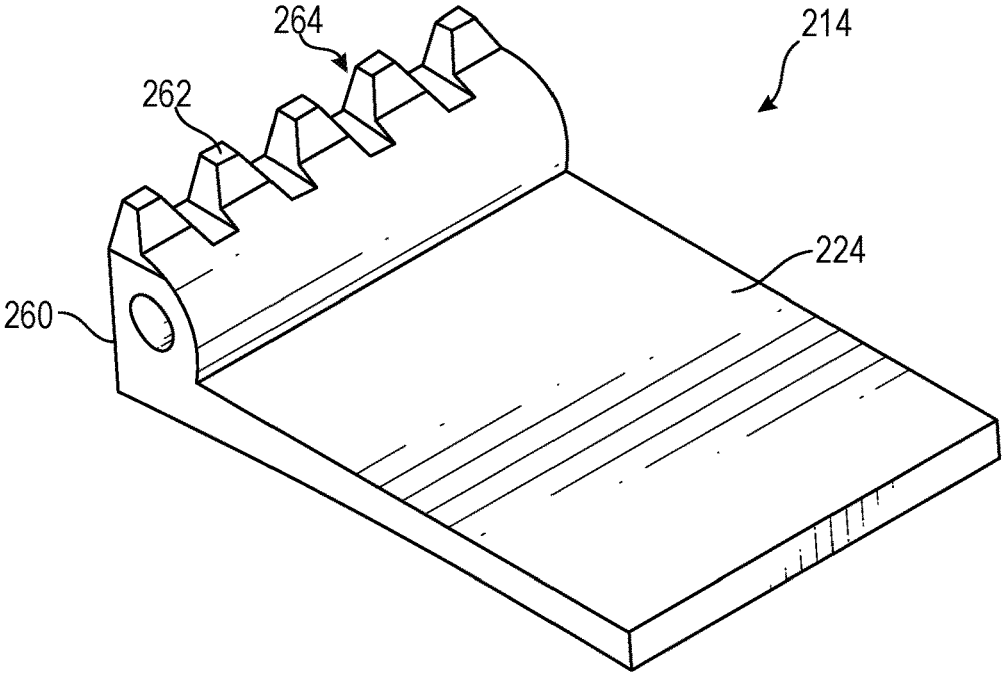
FIG. 10 illustrates a top, front perspective view of a lever.

In some embodiments, as shown in FIG. 10, a lever 214 may comprise a lever arm 224, a top end 260, and a raised end 262 comprising a plurality of protrusions 264. The plurality of protrusions 264 apply additional pressure to the bracelet 102 against the plurality of ridges 156 such that when the bracelet 102 is interposed between the plurality of protrusions 264 and the plurality of ridges 156, the bracelet is prevented from being withdrawn.

When the first and second members 106, 108 are coupled together with the lever 114 (or 214) in the closed configuration 146 (e.g., FIG. 6), the arm 124 of the lever 114 may be secured within the groove 112, providing a comfortable fit along the wrist or neck of the user. The arm 124 of the lever 114 may further have a slight curvature on at least one side corresponding to the curvature of the wrist or neck of the user to further provide that comfortable fit.

Figure 11:
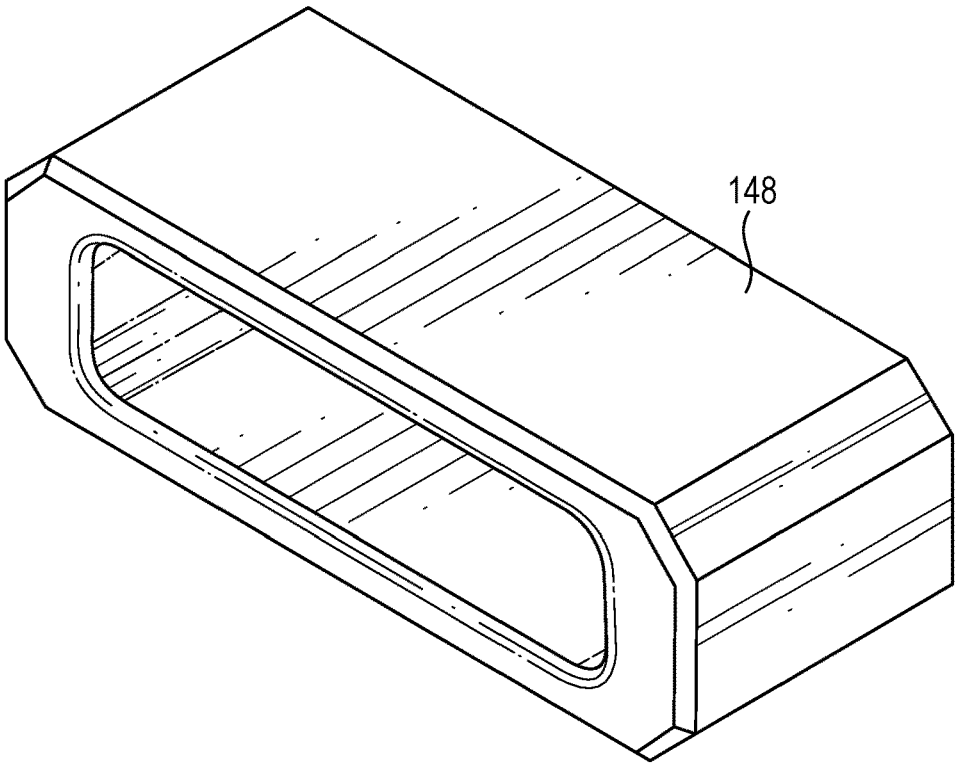
FIG. 11 illustrates a top, front perspective view of a slider charm.

It will be appreciated that the magnetic clasp assembly 104 and the slider charms 148 (FIGS. 1 and 11) may be laser engraved or otherwise feature designs representing the user's life achievements and interests. The slider charms 148 may be freely interchanged with ease according to the user's daily preferences.

It will be appreciated that the first member 106 of the magnetic clasp assembly 104 may be completely removable from the bracelet 102, permitting the user to freely add or remove slider charms 148 to the bracelet 102. The slider charms 148 are retained on the bracelet 102 via the first and second members 106, 108. In other words, an inner circumference of the slider charm 148 is less than an outer circumference of the first and second members 106, 108 such that the slider charms 148 are not capable of sliding over the first and second members 106, 108. Therefore, to add or remove slider charms 148 from the bracelet 102, a user may remove the first member 106 by actuating the lever 114 to release the tension on the bracelet 102 (e.g., raised end 162 rotates to disengage with the bracelet 102), and thereby slide the bracelet 102 out of the bracelet cavity 158. The user may then add or remove slider charms 148 to the bracelet 102 as desired, then feed the bracelet 102 back through into the bracelet cavity 158 (i.e., between the top end 160 of the lever and the ridges 156) to the desired position (sized to the user's wrist, for example), then actuate the lever again 114 to retain the bracelet 102 between the ridges 156 and the raised end 162 (or protrusions 264). The user may then assemble the second member 108 to the first member 106 as described earlier herein, where they are secured to one another via the coupling of the first and second magnets 118, 138, as well as the coupling of the second protrusion 140 in the first receiving slot 122 and the first protrusion 120 in the second receiving slot 142. A user may easily remove the bracelet 102 by simply disconnecting the first member 106 from the second member 108. However, by simply uncoupling the first member 106 from the second member 108, the slider charms 148 are retained on the bracelet 102 as they cannot slide over either the first or the second member 106, 108.

Ease of use permits the user to interchange slider charms 148 more frequently and thereby customize the user's jewelry to display different life events, new achievements, seasonal holidays, awareness and support for significant causes, and other activities. Moreover, the capacity to place the magnetic clasp assembly 104 at any segment of the bracelet 102, particularly when using a braded rope bracelet 102, allows the user to achieve a comfortable custom fit that also accommodates the chosen quantity of slider charms 148 added to the bracelet 102. Accordingly, the article of jewelry with magnetic clasp assembly 100 solves the need for an article of jewelry that easily facilitates the interchange of new slider charms 148 and accessories, and which permits adjustment of the bracelet's 102 sizing around the wrist or neck, overcoming limitations in the prior art.

It will be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. An article of jewelry, comprising:

a bracelet;

a slider charm configured to be slidable on the bracelet; and a magnetic clasp assembly, comprising:

a first member configured to be removably attachable on a first end of the bracelet, the first member, comprising:

a first engagement area comprising a first magnet cavity, a first magnet receivable within the first magnet cavity of the first engagement area, a first protrusion extending perpendicularly to the first engagement area at a first end of the first engagement area, a first receiving slot on a second, opposite end of the first engagement area, a lever arm groove positioned on an underside of the first engagement area, opposite the first magnet cavity, and a lever comprising a lever arm, a top end, and a raised end, the lever arm configured to selectively abut the lever arm groove via pivoting on a pin, a bracelet cavity comprising a plurality of ridges, the plurality of ridges extending toward the top end of the lever in the bracelet cavity, wherein in a first position, the lever arm is substantially perpendicular to the first engagement area and the top end is proximal to the ridges, allowing the first end of the bracelet to be inserted or removed into the bracelet cavity, and in a second position, the lever arm abuts the lever arm groove and the raised end is proximal to the ridges, thereby interposing the first end of the bracelet between the raised end and plurality of ridges, thereby preventing withdrawal of the first end of the bracelet;

a second member on a second end of the bracelet, the second member, comprising:

a second engagement area configured to be complementary in size and shape to the first engagement area of the first member, a second magnet cavity disposed in the second engagement area;

a second magnet receivable within the second magnet cavity, a second protrusion extending horizontally from a first end of the second engagement area and configured to mate with the first receiving slot of the first member, and a second receiving slot at a second end of the second engagement area and configured to mate with the first protrusion of the first member, and a compartment for receiving the second end of the bracelet.

2. The article of jewelry of claim 1, wherein an inner circumference of the slider charm is less than an outer circumference of the first member and the second member.

3. The article of jewelry of claim 1, wherein when the first member of the magnetic clasp assembly is in the first position, the first end of the bracelet may be removed therefrom to facilitate removal or addition of the slider charm to the bracelet.

4. The article of jewelry of claim 1, wherein the bracelet comprises a band, chain, or rope.

5. A method of using an article of jewelry with magnetic clasp assembly, the method comprising:

sliding a charm on a bracelet;

actuating a lever arm of a first member so that the lever arm is substantially perpendicular to a first engagement area of the first member;

coupling a first member to a first end of the bracelet by inserting the first end into a bracelet cavity;

actuating the lever arm of the first member so that the first end of the bracelet is interposed between a raised end of a lever and a plurality of ridges to secure the bracelet in the bracelet cavity, the lever arm abutting a lever arm groove;

coupling a second member to a second end of the bracelet via a compartment;

coupling a second protrusion of the second member to a first receiving slot of the first member;

coupling a first protrusion of the first member to a second receiving slot of the second member, which simultaneously couples a first magnet to a second magnet; and actuating the lever between an open configuration and a closed configuration to add or remove charms from the bracelet.

* * * * *